United States Patent [19]

Utracki

[11] 4,376,002

[45] Mar. 8, 1983

[54] MULTI-INGREDIENT GAS GENERATORS

[75] Inventor: Lechoslaw A. M. Utracki, Pierrefonds, Canada

[73] Assignee: C-I-L Inc., Ontario, Canada

[21] Appl. No.: 255,993

[22] Filed: Apr. 21, 1981

[30] Foreign Application Priority Data

Jun. 20, 1980 [CA] Canada ..... 354511

[51] Int. Cl.[3] ..... C06B 35/00

[52] U.S. Cl. ..... 149/35; 149/40

[58] Field of Search ..... 149/35, 40

[56] References Cited

U.S. PATENT DOCUMENTS 3,895,098 7/1975 Pietz ..... 149/35 X 3,931,040 1/1976 Breazeale ..... 149/35 X 4,094,028 6/1978 Fujiyama et al. ..... 149/35 X 4,203,787 5/1980 Kirchoff et al. ..... 149/35

*Primary Examiner*—Stephen J. Lechert, Jr.

[57] ABSTRACT

An improved nitrogen gas generating pyrotechnic composition is provided which consist of a stoichiometric mixture of an alkali metal azide or alkaline earth metal axide fuel and an oxidant consisting of a mixture of at least two metal oxides selected from the oxides of iron, silicon, manganese, tantalum, niobium and tin. The mixed metal oxides provide a synergistic effect and result in a composition having improved ignition delay time, burn rate and gas pressure as well as a reduction in toxic by-products and dust.

1 Claim, 2 Drawing Figures

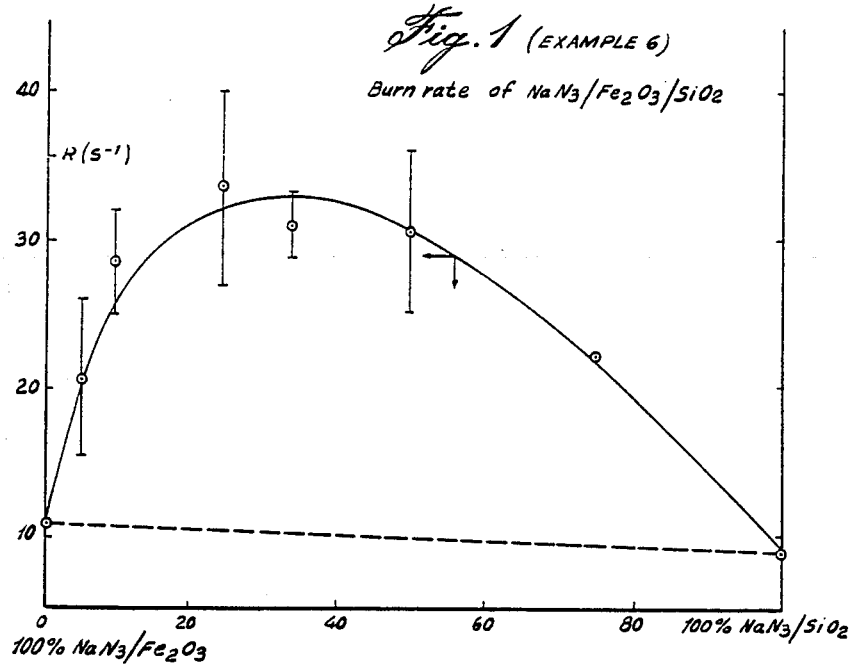
Fig. 1 (EXAMPLE 6)
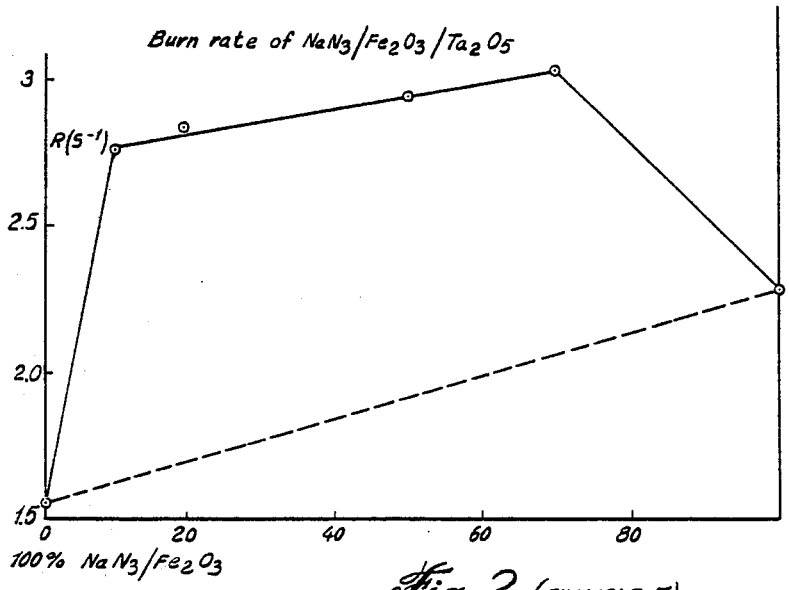
Fig. 2 (EXAMPLE 7)

MULTI-INGREDIENT GAS GENERATORS

This invention relates to a chemical gas generating composition in solid form capable, upon ignition, of rapidly producing large volumes of non-toxic gases. The gas generating composition of the invention is particularly adapted for inflating safety crash bags in passive restraint systems for passenger vehicles.

The use of protective gas inflated bags to cushion vehicle occupants in a crash situation is now widely known and well documented. In the first devised systems of this type, a quantity of compressed, stored gas was employed to inflate a crash bag which upon inflation was imposed between the occupant and the windshield, steering wheel and dashboard of the vehicle. In response to rapid deceleration of the vehicle, as in an accident situation, the gas was released through a quick-acting valve or the like to inflate the crash bag. Because of the bulk of the apparatus, its generally slow reaction time and its maintenance difficulties this stored, pressurized gas system has now largely been superseded by a system which utilizes the gases generated by the ignition of a chemical gas generating pyrotechnic substance or composition. Such a chemical system employs an ignition means such as an electrically activated squib or the like associated with a suitable sensing means to ignite the gas generating composition.

A large number of quick-burning gas generating compositions have been proposed for crash bag inflation purposes, many of which have proven deficient in one respect or other. It has been a preoccupation of the industry to develop a gas generating composition which combines the essential features of a short induction period, a burn rate which is rapid but without any explosive effect, a high bulk density, so that only a small amount of composition is required to produce large amounts of gas; the production of only non-toxic gases, so that vehicle occupants are not endangered in the event of a leak or during the venting of the crash bag after development; the production of gases at a relatively low temperature, so that damage to the crash bag is minimized and occupants are not burned; good filterability of the reaction products, so that hot solid residue cinders are simply removed from the gas stream; and strong physical form, so that long period of storage can be attained under wide ranging conditions of temperature cycling and shock. While some or other of these desirable properties are found in known chemical gas generating compositions, heretofore it has not been possible to provide compositions which satisfy all the requirements of the industry.

The most widely accepted prior art gas generating compositions generally comprise a mixture or blend of an alkali metal or earth metal azide, usually sodium azide, and one or other of a selected oxidizer, commonly a metal oxide. Sometimes a small amount of a burning catalyst is included in the mixture to speed up the burn rate or reaction time. In some cases the metal oxide is replaced by a metallic chloride, nitrate, sulfate, peroxide, perchloride or other oxidizer. A wide range of these selected combinations are to be found in the patent literature. (See, for example, U.S. Pat. Nos. 2,981,616, 3,122,462, 3,741,585, 3,755,182, 3,773,947, 3,779,823, 3,895,089, 3,806,461, 3,833,432, 3,912,561, 3,883,373, 3,996,029, 3,391,040 and 4,062,708).

In all of the aforementioned patents the search has been directed to providing a composition which combines safety, low cost and gas generating effectiveness. With the advance of technology in the field of vehicle air bags systems, an ever increasing desire has been expressed for a gas generant of yet further improved performance in terms of ease of ignition, filterability, improved burn rate and reduced costs. Some distance in the direction of improved performance has been gained by the addition to known formulations of further oxidizers such as, for example, $NaNO_3$ or $KClO_4$. However, while the addition of these materials increases the composition burn rate, they also tend to undesirably increase flame temperature and to increase the production difficult-to-filter particulates upon ignition. Thus further improved performance within the limitations of prior art knowledge heretofore has been deemed unlikely.

In the combustion of, for example, a stoichiometric mixture of sodium azide and metal oxide, the reaction products obtained may include nitrogen, molten metal, sodium oxide, sodium salt of the metal and metal nitride. One or other or several of these products are produced depending on the type of metal oxide selected. Generally, the more reactive the metal of the oxide the more numerous are the products obtained. Because of the desire to reduce the amounts of sodium oxide and metal nitrides and to increase the amounts of nitrogen gas, the choice of metal oxide must be carefully made. It has been found that by a judicious selection of a combination of metal oxides, a multi-ingredient gas generating composition may be provided which can be tailored to a system which has the desired ignitibility, burn rate, gas efficiency, filterability, low hazard and low cost, which system is eagerly sought by the industry.

It is an object of the present invention to provide an improved solid gas generating composition which possesses, in particular, a high degree of safety in handling and manufacture, a rapid burn rate together with a controlled flame temperature, a very high level of gas cleanliness and a very low level of toxic ignition by-products.

The improved gas generating composition of the present invention comprises one or more alkali metal azides or alkali earth metal azides in admixture with a stoichiometric amount of at least two metal oxides selected from the group consisting of $Fe_2O_3$, $SiO_2$, $MnO_2$, $Ta_2O_5$, $Nb_2O_5$ and $SnO_2$.

For optimum results, the compositions may optionally contain a minor amount of a further metal oxide selected from the group of $TiO_2$, $Al_2O_3$ and ZnO or mixtures of these.

The compositions of the invention demonstrate a surprising synergism in that the actual measured properties resulting from the use of a mixture of the selected metal oxides are superior to the properties anticipated from a simple mechanical mixture. In particular, ignition delay time, pressure of the gases generated, burn rate, amount of free sodium in the residue, dust after ignition and flame temperature can be shown to deviate favourably from the expected results as determined by calculation.

The metallic azides suitable for use in the compositions of the invention are the alkali metal and alkali earth metal azides, in particular, sodium azide, potassium azide, lithium azide, calcium azide and barium azide. The method of manufacture of the gas generating compositions of the invention is a simple one which merely requires the combination of fine granular or powdered alkali metal or alkali earth metal azide and very fine particulate metal oxides to thoroughly mix the ingredients. The resulting combined ingredients may then be prepared in a suitable physical form for use in air bag inflation such as in the form of compressed pellets or tablets or as porous granules as disclosed in U.S. Pat. No. 3,996,079.

The following examples and tables illustrate the improved properties and characteristics of the gas generating composition of the present invention. In the examples and accompanying text the various gas generant compositions or formulations are designated by means of formulation labels as indicated below:

| Formulation Label | Sodium azide/Metal Oxide molar ratio | Metal Oxide |
|---|---|---|
| F9 | 4/1 | $Fe_2O_3$ |
| SA | 4/1 | $SnO_2$ |
| M | 8/3 | $MnO_2$ |
| CA | 4/3 | $SiO_2$ |
| TA | 10/1 | $Ta_2O_5$ |
| Z | 4/3 | ZnO |
| A | 4/1 | $Al_2O_3$ |
| TI | 4/1 | $TiO_2$ |

The compositions in the following examples are designated and discussed in terms of the above defined formulations.

EXAMPLES 1–2

To demonstrate the utility of the multi-component gas generants of the present invention, a series of compositions comprising stoichiometric mixtures of sodium azide and at least two metal oxides were prepared and burned. The performance results obtained were compared with measured results from the burning of conventional sodium azide/iron oxide mixtures. In all cases the compositions were in the form of one inch diameter pressed pellets weighing 20 grams. The results are tabulated in Table I, below. F9 composition is used in Example 1 while the composition of Example 2 comprises a mixture of F9 and SA in a weight ratio F9/SA of 9:1.

TABLE I

| | Example 1 $NaN_3/Fe_2O_3$ | Example 2 $NaN_3/SnO_2/Fe_2O_3$ |
|---|---|---|
| Pellet Density (g/ml) | 2.127 | 2.101 |
| Ignition delay time (ms) | 1041 | 525 |
| Generator Press max. (psi) | 1371 | 1413 |
| Burn rate as (dlnP/dt) max. ($s^{-1}$) | 1.55 | 2.04 |
| Na in cinder* | 2 | 0 |
| Dust in gas* | 3 | 1 |
| Flame temp. (°C.) calc. | 1026 | — |
| measured | 990 | — |

*Relative and based on a scale from 0–10

From Table I it can be seen that the Example 2 composition containing both tin oxide and iron oxide was superior in all performance characteristics to the conventional azide/iron oxide composition of Example 1. It can be noted that the composition of Example 2 differs from that of Example 1 by the incorporation of 10% SA composition.

EXAMPLES 3–5

A further series of multi-component gas generants similar to those of Examples 1 and 2 were prepared except that the form of the composition was that of extruded granular particles each about 1.14 inch in outside and 0.04 inch in inside diameter×0.50 inch in length. Quantities of 12 grams of each composition were burned and the performance results obtained were compared with those from the burning of conventional azide/iron oxide mixtures. The results are tabulated in Table II below. In Example 3, the performance of the F9 formulation is shown. The compositions employed in Examples 4 and 5 respectively comprise mixtures of CA and M in the weight ratio 1:2 (Example 4) and F9:CA:M in the weight ratio 3:1:3 (Example 5)

TABLE II

| | Example 3 $NaN_3/Fe_2O_3$ | Example 4 $NaN_3/SiO_2/MnO_2$ | Example 5 $NaN_3/Fe_2O_3/MnO_2SiO_2$ |
|---|---|---|---|
| Bulk Density (g/ml) | 1.083 | 0.998 | 0.994 |
| Ignition delay time (ms) | 138 | 41 | 25 |
| Generator pressure max. (psi) | 1022 | 2209 | 1530 |
| Burn rate as (dlnP/dt) max. ($s^{-1}$) | 9.9 | 101 | 66 |
| Sodium in cinder | 1 | 8 | 0 |
| Dust in gas | 5 | 1 | 1 |
| Flame temp. (°C.) calc. | 1026 | 1040 | 1064 |
| measured | 990 | 837 | 1033 |

From Table II it can be seen that the compositions of Examples 4 and 5 demonstrate vastly superior properties over the conventional azide/iron oxide material of Example 3. Particular attention is directed to the burn rate of the composition of Example 4 which is greater by a factor of 10 than that of the conventional composition of Example 3.

EXAMPLES 6–7

To demonstrate a synergistic effect found with the multi-component gas generants of the invention, the burn rate of a three-component generant was compared to the burn rate of separate two-component generants employing the same metallic oxides.

The results are demonstrated in the attached drawings, where

FIG. 1 shows the burn rate of extruded grains of a generant comprising $NaN_3/Fe_2O_3/Ta_2O_5$ and FIG. 2 shows the burn rate of extruded grains of a generant comprising $NaN_3/Fe_2O_3/Ta_2O_5$.

The solid lines in the two figures indicate the experimentally determined burn-rate dependence on composition whereas the broken lines indicate the "expected" dependence, in the absence of a synergistic effect. The abscissa in FIG. 1 gives the weight ratio of the formulas F9 and CA in the mixture. That in FIG. 2 refers to weight ratio of F9 and TA formulas.

With particular reference to FIG. 1 (Example 6), the solid line shows the burn rate R with dependence on the composition while the broken line shows the expected burn rate R with dependence on the composition. The left hand margin of the graph shows a scale of the rate of gas generated expressed as (dlnP/dt) max ($s^{-1}$). The vertical lines show the spread of R-values. It will be seen by reference to FIG. 1 that compositions comprising less than 40% $NaN_3/SiO_2$ have excellent burn rates in the range of 11 to 33 ($s^{31\ 1}$). This good burn rate is achieved through an increase of flame temperature resulting from the chosen mixture of ingredients, and, in turn, augments gas production and generates an easily filterable cinder.

It may be mentioned that due to low bulk density of the formula CA, the compositions containing more than 40% $NaN_3/SiO_2$ have a poor gas yield (per unit volume of the gas generator) and are not of a practical use.

The optimum formula or blend chosen will be influenced by the type and construction of the gas generator apparatus employed.

With reference to FIG. 2 (Example 7) there is shown in broken line the expected or anticipated burn rate predicted by additivity rule while the solid line shows actual experimental results from the burning of a multi-component gas generant.

The results demonstrate a surprising synergism, particularly where the amount of $NaN_3/Ta_2O_5$ in the mixture is low. Thus it can be seen that the addition of relatively small amounts of tantalum oxide to a conventional $NaN_3/Fe_2O_3$ gas generant, significantly improved performance. Pure $Ta_2O_5$ is prohibitively expensive. However, due to close similarity in atomic or ionic size, ionization and electrode potential it shows nearly identical chemical reactivity as its mixtures with niobium. Tantalum is found in a number of ores invariably containing niobium. Some of them, viz. tantalite or columbite contain up to 92% of $(Ta,Nb)_2O_5$ which can be successfully used as substitute for $Ta_2O_5$ in Example 7.

EXAMPLE 8

To further demonstrate the synergism found in the gas generants of the present invention, standard or conventional two-component gas generants were burn-tested and the performance parameters recorded. From the results obtained the expected performance parameters of mixtures of the two-component gas generants were calculated by algebraic averaging and these expected results were compared with actual measured results from the burning of one inch diameter, 20 g. pellets of the mixtures. The results are shown in Table III below.

TABLE III

| Parameter | $NaN_3/Fe_2O_3$ | $NaN_3/SnO_2$ | $NaN_3/Fe_2O_3/SnO_2$ Expected | $NaN_3/Fe_2O_3/SnO_2$ Measured |
|---|---|---|---|---|
| Pellet Density (g/ml) | 2.127 | 2.221 | 2.136 | 2.101 |
| Ignition delay time (ms) | 1041 | 533 | 990 | 525 |
| Generator max. pressure (psi) | 1371 | 1304 | 1364 | 1413 |
| Burn rate as (dlnP/dt) max. ($s^{-1}$) | 1.55 | 1.41 | 1.54 | 2.04 |
| Free sodium in cinder (relative) | 2 | 2 | 2 | 0 |
| Dust in the gas phase (relative) | 3 | 2 | 2-3 | 1 |
| Flame temperature (°C.) calculated | 1026 | 921 | — | — |
| measured | 990 | — | — | — |

From the results in Table III it will be seen that the measured ignition delay time, gas pressure, burn rate and residues of the three-component mixture were all superior to the calculated, expected results.

EXAMPLE 9

The synergism found in the gas generants of the present invention was further demonstrated by comparing the performance parameters of burned, extruded particles of conventional two-component systems with the results obtained from the burning of similar extruded three-component and four-component mixtures. The results were contrasted with the expected performance parameters calculated by algebraic averaging. The results are tabulated in Table IV below.

TABLE IV

| Parameter | System $NaN_3/Fe_2O_3$ | System $NaN_3/SiO_2$ | System $NaN_3/MnO_2$ |
|---|---|---|---|
| Bulk Density (g/ml) | 1.083 | 0.654 | 1.109 |
| Ignition delay time (ms) | 138 | 12 | 118 |
| Generator Maximum Pressure (psi) | 1022 | 1036 | 966 |
| Burn rate as (dlnP/dt) max ($s^{-1}$) | 9.9 | 8.5 | 9.8 |
| Sodium in the cinder (relative) | 1 | 1 | 8 |
| Dust in the gas phase (relative) | 5 | 3 | 1 |
| Flame Temp. (°C.) calculated | 1026 | 987 | — |
| measured | 990 | 998 | — |

| | System Blends of $NaN_3/MnO_2$ | | | | | |
|---|---|---|---|---|---|---|
| | (1) $NaN_3/MnO_2/SiO_2$ | | (2) $NaN_3/MnO_2/SiO_2$ | | (3) $NaN_3/MnO_2/SiO_2/FeO_3$ | |
| Parameter | Exp. | Meas. | Exp. | Meas. | Exp. | Meas. |
| Bulk Density (g/ml) | 0.995 | 0.913 | 0.957 | 0.998 | 1.033 | 0.994 |
| Ignition delay time (ms) | 106 | 38 | 96 | 41 | 111 | 25 |
| Generator Maximum pressure (psi) | 1025 | 1869 | 1027 | 2009 | 1000 | 1530 |
| Burn rate as (dlnP/dt) $_{max}$ ($s^{-1}$) | 9.5 | 80 | 9.4 | 101 | 9.7 | 66 |
| Sodium in the cinder (relative) | 1 | 3 | 1 | 8 | 4 | 0 |
| Dust in the gas phase (relative) | 4 | 4 | 4 | 1 | 3 | 1 |
| Flame Temp. (°C.) calculated | 1260 | | 1040 | | 1064 | |
| measured | 959 | | 837 | | 1033 | |

Notes:
Compositions (1), (2), and (3) comprise the following weight ratios of the two-component mixtures, respectively.
(1) M:CA = 3:1
(2) M:CA = 2:1
(3) M:CA:F = 3:1:3

It will be seen from Table IV that in all cases the measured results from the burning of the multi-component generants were superior to the expected, calculated results. This is particularly evident in the burn rate measurements.

A particular problem facing the passive air bag industry has been the development of effective, low cost filtering means for the removal from the generated gas, prior to bag inflation, of the residue or cinder carried in the gas stream. Where some of this residue is in liquid form, for example, from molten metal, mechanical filters tend to quickly become clogged and block free passage of the gas. While the production of liquid residue may be controlled through the use of cooler burning mixtures, this results in an undesirable sacrifice in both burn rate and gas generating efficiency. Hence it has been the desire of the industry to utilize a high burn rate, high gas generating material while maintaining an easy-to-filter residue. It has now been found that the addition to a multi-component gas generant of a secondary metal oxide selected from aluminium oxide, titanium oxide and zinc oxide or mixtures of these, results in the production of an easily filterable, semi-solid cinder without sacrifice in performance of the generant. It has also been found that the same secondary metal oxides, aluminum oxide, titanium oxide and zinc oxide or mixtures of thereof, may be added to simple or conventional two-component gas generants to produce a similar, easily filterable residue. Generally, the quantity of secondary metal oxide employed as a residue controller is no more than one part of secondary metal oxide to one part of the primary metal oxide or oxides.

EXAMPLE 10

To demonstrate the improved quality of residue obtained by the use of a secondary metal oxide, a stoichiometric composition comprising sodium azide/silicon oxide/manganese oxide was compounded in extruded grain form with and without the inclusion of the secondary metal oxide, titanium oxide. Both compositions were ignited and the results obtained are shown in Table V, below:

TABLE V

| | $NaN_3/SiO_2/MnO_2$ | $NaN_3/SiO_2/MnO_2/TiO_2$* |
|---|---|---|
| Density | 0.913 | 0.870 |
| Ignition delay time (ms) | 38 | 117 |
| Generator pressure (psi) | 1869 | 1580 |
| Burn rate | 80 | 44.2 |
| Sodium in cinder (relative) | 3 | 1 |
| Flame temp. (°C.) | 959 | 960 |
| Type of residue | liquid | semi-solid |

*The composition is a stoichiometric blend of $NaN_3/SiO_2/MnO_2$ and $NaN_3/SiO_2/TiO_2$.

EXAMPLE 11

To demonstrate the improved cinder-forming properties of a gas generating composition of the invention containing aluminium oxide as a secondary metal oxide, two stoichimetric compositions were prepared. Composition CA comprised sodium azide/silicon dioxide (4/3) while composition CAA comprised the same composition but 50 mole % of the silicon dioxide was replaced by aluminium oxide. Both compositions were prepared in identical porous granular form and ignited. The results are shown in Table VI below:

TABLE VI

| Property | CA | CAA* |
|---|---|---|
| Bulk density (g/ml) | 0.658 | 0.688 |
| Ignition delay time (ms) | 16 | 159 |
| Generator pressure (psi) | 996 | 1014 |
| Burn rate ($s^{-1}$) | 6.3 | 7.2 |
| Crush strength (kg) | 3.8 | 4.4 |
| Sodium in cinder | 1 | 4 |
| Dust | 4 | 4 |
| Flame temperature (calc) (°C.) | 978 | 818 |

TABLE VI-continued

| Property | CA | CAA* |
|---|---|---|
| Type of residue | viscous liquid | solid |

*CAA is the same composition as CA but 50 mole % of $SiO_2$ was replaced by $Al_2O_3$.

It can be noted that substitution of 50 mole % of $SiO_2$ in CA formula by $Al_2O_3$ resulted in stronger grain, which burned faster and at the same time cooler than CA. The reaction products of CAA were easy-to-filter solids.

EXAMPLE 12

Two stoichiometric compositions were prepared, extruded and tested as in Example 11. Composition A comprised a mixture of sodium azide/manganese dioxide/silicon dioxide wherein the moles ratio of the two metal oxides was 1:1. Composition B comprised a mixture of sodium azide/manganese dioxide/aluminium oxide. The results are shown in Table VII below:

TABLE VII

| Property | Comp A (with $SiO_2$) | Comp B (with $Al_2O_3$) |
|---|---|---|
| Bulk density (g/ml) | .913 | 1.103 |
| Ignition delay time (ms) | 38 | 106 |
| Generator pressure (psi) | 1839 | 1128 |
| Burn rate ($s^{-1}$) | 80 | 19 |
| Crush strength (kg) | 3.8 | 5.3 |
| Sodium in cinder | 3 | 2 |
| Dust | 4 | 3 |
| Flame temperature (calc) (°C.) | 1103 | 960 |
| (measured) | 959 | 820 |
| Type of residue | liquid | semi-solid |

The results in Table VII show that the incorporation of $Al_2O_3$ improves the mechanical strength of the grains. The composition containing $Al_2O_3$ burns cooler and slower than that with $SiO_2$. The cinder resulting from burning of Comp A was a low-viscosity liquid which entirely penetrated the filtering means. By contrast, the cinder of Comp B was a white-water-soluble powder held back by the filtering means.

For optimious results for a composition for use in a vehicle passive restraint system, a formulation lying between that of Composition A and Composition B would be selected. By appropriate selection of materials and adjustment of the blends, a gas generant can be provided having the desired burn performance.

I claim:

1. A solid nitrogen gas generating composition comprising a substantially stoichiometric admixture of (a) a fuel selected from the group consisting of alkali metal azides and alkaline earth metal azides, (b) a synergistically acting primary oxident component consisting of a mixture of at least two metal oxides selected from the group consisting of the oxides of iron, silicon, manganese, tantalum, niobium and tin, and (c) a residue control agent comprising a secondary metal oxide selected from the group consisting of the oxides of titanium, aluminium and zinc or mixtures of these.

* * * * *